US005219461A

United States Patent [19]

Hyll et al.

[11] Patent Number: 5,219,461

[45] Date of Patent: Jun. 15, 1993

[54] REINFORCED ELASTOMER LINING FOR PUMP CASING AND ASSOCIATED METHOD OF MANUFACTURE

[75] Inventors: John Hyll, Sandy; Roger S. Turley, West Jordan; Steven G. Purdy, Kaysville; Jay L. Ostler, Sandy; Claude R. Hood, Jr., Magna, all of Utah

[73] Assignee: Baker Hughes Incorporated, Houston, Tex.

[21] Appl. No.: 875,244

[22] Filed: Apr. 28, 1992

[51] Int. Cl.[5] ..... F04D 29/02

[52] U.S. Cl. ..... 415/197; 264/255; 264/257

[58] Field of Search ..... 415/197, 9, 128; 264/255, 257

[56] References Cited

U.S. PATENT DOCUMENTS

| | | | |
|---|---|---|---|
| 4,113,407 | 9/1978 | Grzina | 415/197 |
| 4,120,605 | 10/1978 | Hurst | 415/197 |
| 4,234,291 | 11/1980 | Hurst et al. | 415/197 |
| 4,321,742 | 3/1982 | Hurst et al. | 29/445 |
| 4,566,850 | 1/1986 | Grzina | 415/128 |
| 4,776,760 | 10/1988 | Grisz | 415/197 |
| 5,029,878 | 7/1991 | Ray | 277/170 |

*Primary Examiner*—Edward K. Look
*Assistant Examiner*—Michael S. Lee
*Attorney, Agent, or Firm*—R. Neil Sudol; Henry D. Coleman

[57] ABSTRACT

A replaceable lining for a centrifugal pump casing includes a continuous substantially rigid shell made of thermoset plastic resin material reinforced with woven roving fiberglass fabric sheets and randomly dispersed glass fibers. The lining also includes an elastomer layer bonded to an inner surface of the rigid shell. Both the elastomer layer and the shell have a volute section and a semicylindrical or semiconical discharge section integral therewith. The discharge section of the shell is provided along an outer surface with a set of outwardly projecting arcuate reinforcement ribs spaced along the discharge section. The ribs are integral with the shell. The shell is preformed and adhesively bonded to the elastomer layer during a compression molding step of a manufacturing process.

26 Claims, 2 Drawing Sheets

REINFORCED ELASTOMER LINING FOR PUMP CASING AND ASSOCIATED METHOD OF MANUFACTURE

BACKGROUND OF THE INVENTION

This invention relates to a reinforced elastomeric lining for a pump casing. More particularly, this invention relates to a half-shell reinforced elastomer lining for a centrifugal pump casing. In addition, this invention relates to a method for manufacturing a pump lining.

Centrifugal pumps for moving slurries and corrosive liquids such as acids are generally protected on their inner surfaces with elastomer linings. To prevent collapse of a lining during use, particularly in a large centrifugal pump, the lining is occasionally bonded to the pump casing. U.S. Pat. No. 3,607,600 to Shreter discloses a bonding technique wherein the inner surface of the pump casing is provided with a coating of elastomer, then a layer of chopped fibers and several layers of synthetic resin material. The synthetic resin is rolled to mix the elastomer, the resin and the fibers.

A primary disadvantage of attaching a lining to a pump casing becomes obvious when the lining wears out and requires replacement. Frequently, the entire pump casing must be replaced.

U.S. Pat. No. 4,776,760 to Grisz discloses a centrifugal pump lining which is reinforced in selected areas with a resin impregnated fabric which permits the elastomer to shrink its normal amount during curing. In manufacturing such a pump lining, a mold is lined with thermosetting resin impregnated fabric in those regions where reinforcement is desirable. Once one or more fabric layers are in place, the uppermost fabric sheet is coated with a bonding material or adhesive for vulcanizing the elastomer to the fabric material. The elastomer is typical in the form of sheets which are deposited over the adhesive coating. The mold is subsequently closed and subjected to compression and heat for a predetermined period. The elastomer, adhesive and thermoset impregnated fabric are cured for a time and at a temperature sufficient to cure both the elastomer and the resin. During the curing process, the elastomer and the resin shrink to a similar extent.

Conventional rubber linings are difficult to match precisely to the inner surfaces of the casings into which the are placed. Because of shrinkage gradients, some warpage inevitably occurs during the curing process. Shrinkage problems escalate with increasing pump casing size and variation in elastomer type.

SUMMARY OF THE INVENTION

A replaceable lining for a centrifugal pump casing comprises, in accordance with the present invention, a continuous substantially rigid shell having a volute section and a semicylindrical or semiconical discharge section integral therewith. The shell is made of a thermoset plastic resin material reinforced with glass fibers. The lining further comprises an elastomer layer adhesively bonded to the shell along an inner surface thereof More specifically, the elastomer layer is vulcanized to the shell along an inner surface thereof.

Pursuant to another feature of the present invention, the shell is provided along an outer surface with at least one outwardly projecting arcuate reinforcement rib. The rib is preferably integral with the shell. More specifically, the discharge section of the shell is provided along an outer surface with a plurality of outwardly projecting semicircular reinforcement ribs spaced from one another along an outer surface of the discharge section of the shell. Also, the volute section of the shell may additionally or independently be provided with one or more outwardly projecting arcuate reinforcement ribs.

According to another feature of the present invention, the shell of the lining includes a layer of fiberglass fabric material impregnated with the thermoset plastic resin material and a layer of glass fibers dispersed randomly throughout a matrix of the thermoset plastic resin material.

Pursuant to an additional feature of the present invention, the elastomer layer is provided at a free end of the discharge section with a semicircular reinforcement ring segment. That reinforcement ring is made preferably of metal and more preferably of steel. However, other strong materials may be alternatively used.

A replaceable lining for a centrifugal pump casing comprises, in accordance with another conceptualization of the present invention, an elastomer layer having a volute section and a semicylindrical or semiconical discharge section integral therewith, a semicylindrical or semiconical reinforcement layer made of a fiberglass reinforced thermoset plastic resin material adhesively bonded to an outer surface of the discharge section, and at least one outwardly projecting arcuate reinforcement rib integral with the reinforcement layer.

As discussed hereinbefore, the reinforcement rib may be semicircular. Moreover, there may be a plurality of outwardly projecting arcuate reinforcement ribs spaced from one another along the discharge section. Preferably, the reinforcement layer includes a volute section adhesively bonded or vulcanized to the volute section of the elastomer layer. In that case, one or more outwardly projecting arcuate reinforcement ribs may be provided along the volute section of the reinforcement layer.

A method for manufacturing a replaceable lining for a pump casing comprises, in accordance with the present invention, the steps of (a) forming a hard shell of a thermoset plastic resin material reinforced with fiberglass, (b) depositing an adhesive coating along an inner surface of the shell, and (c) molding an elastomer layer onto the inner surface so that the elastomer layer is bonded thereto via the adhesive coating. More specifically, the molding is accomplished at normal molding temperatures to vulcanize the elastomer lining to the shell.

According to another feature of the present invention, the forming of the shell is implemented in a shell mold. If the mold is suitable for compression, injection or transfer molding, then it may also be used to form the elastomer layer. Alternatively, a second mold may be used to form the elastomer layer, in which case the shell is transferred from the shell mold to the second mold.

Pursuant to another feature of the present invention, the formation of the shell comprises the steps of (i) placing a fiberglass fabric sheet into the shell mold, (ii) impregnating the fabric with the thermoset plastic resin material, and (iii) depositing more of the resin material together with glass fibers in a random pattern over the impregnated fabric. Preferably, the fabric is of woven roving. The resin material may be sprayed, brushed, squeegeed or rolled onto the fabric to impregnate the sheet with the resin, whereas the random deposition of short, nonwoven glass fibers and the resin material is accomplished via a chopper gun.

Where the lining is for a centrifugal pump so that the shell has a volute section and a semicylindrical or semiconical discharge section integral therewith, the manufacturing method includes the additional step of providing at least one arcuate rib on an outer surface of the discharge section during the step of forming.

In another step, a semicircular reinforcement ring segment is attached to a free end of the discharge section of the elastomer layer. The ring is preferably made of metal and disposed inside the elastomer during a compression molding of the elastomer layer onto the shell.

According to yet another feature of the present invention, the manufacturing method also comprises the steps of removing from a mold the shell with the elastomer layer attached thereto, disposing about a support frame at least a portion of the shell with the elastomer layer attached thereto, and cooling the composite lining while maintaining same supported on the frame.

A method in accordance with the present invention for manufacturing a pump lining produces a pump lining without shrinkage of the elastomer. The compression molding of an elastomer lining layer to a preformed reinforcement shell prevents shrinkage of the elastomer. Accordingly, the pump casing can be manufactured to the same dimensions as the lining mold. The elimination of lining shrinkage has the further advantage of providing a close and accurate fit of the lining to the casing independently of the elastomer type. Errors inherent in predicting lining distortion with different elastomers upon cooling have been eliminated.

The reinforcement shell of a lining in accordance with the present invention can be built up to a desired thickness in any section of the liner to control strength and rigidity. A thickness of one-quarter inch is considered average. The reinforcement shell is formed by a combination of procedures, including fabric layering and fiberglass chopper techniques. This facilitates the production of a shell having desired thickness and strength characteristics.

A pump casing lining in accordance with the present invention is easier to handle than conventional rubber linings. The reinforcement shell provides a rigidity which maintains the form of the lining during placement of the lining in a pump casing. This ease of handling is particularly advantageous where the lining is for a large pump and/or when the lining is installed in a vertical orientation.

DETAILED DESCRIPTION

Figure 1:
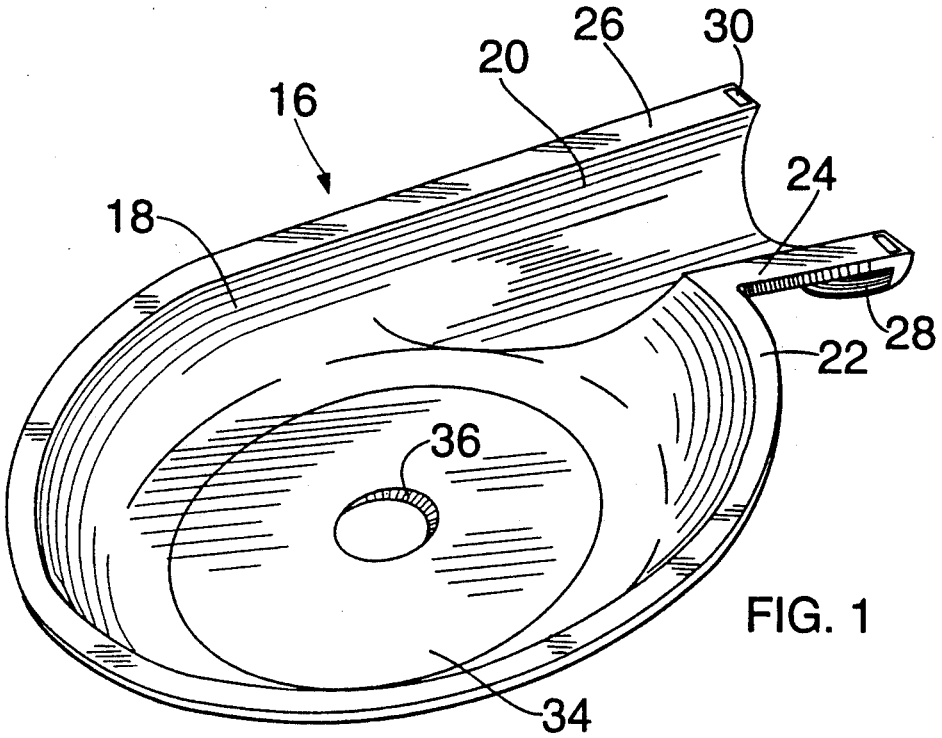
FIG. 1 is a perspective view of a half-shell lining for a centrifugal pump, in accordance with the present invention, showing the lining with a disk member.

As shown in the drawings, a replaceable half-shell for a centrifugal pump comprises a continuous substantially rigid shell 10 having a volute section 12 and a semicylindrical or semiconical discharge section 14 integral therewith. Shell 10 is made of a thermoset plastic resin material such as vinyl ester, polyester or epoxy, reinforced with glass fibers.

The half-shell lining further comprises an elastomer layer 16 adhesively bonded via a vulcanizing process to shell 10 along an inner surface thereof. More particularly, elastomer layer 16 includes a volute section 18 and a semicylindrical or semiconical discharge section 20 integral therewith. Elastomer volute section 18 is substantially coextensive with and attached to volute section 12 of shell 10, while discharge section 20 of elastomer layer 16 is substantially coextensive with and attached to discharge section 14 of shell 10.

Elastomer layer 16 is formed along a circular edge or rim of volute section 18 with a substantially annular flange 22. In addition, discharge section 20 of elastomer layer 16 is provided with a pair of substantially longitudinal flanges 24 and 26 and a semicircular terminal flange 28. Embedded in terminal flange 28 is a semicircular metal reinforcement ring segment 30.

Shell 10 may be provided with flanges (not shown) at least partially coextensive with flanges 22, 24, 26 and 28. However, flanges on shell 10 are not necessary.

Figure 3:
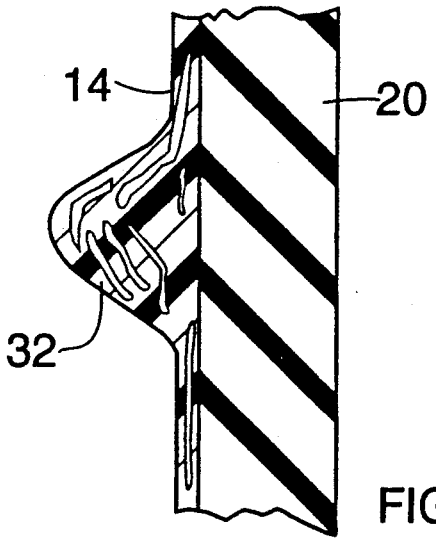
FIG. 3 is a partial cross-sectional view of the lining of FIGS. 1 and 2, taken along line 3—3 in FIG. 2.
Figure 2:
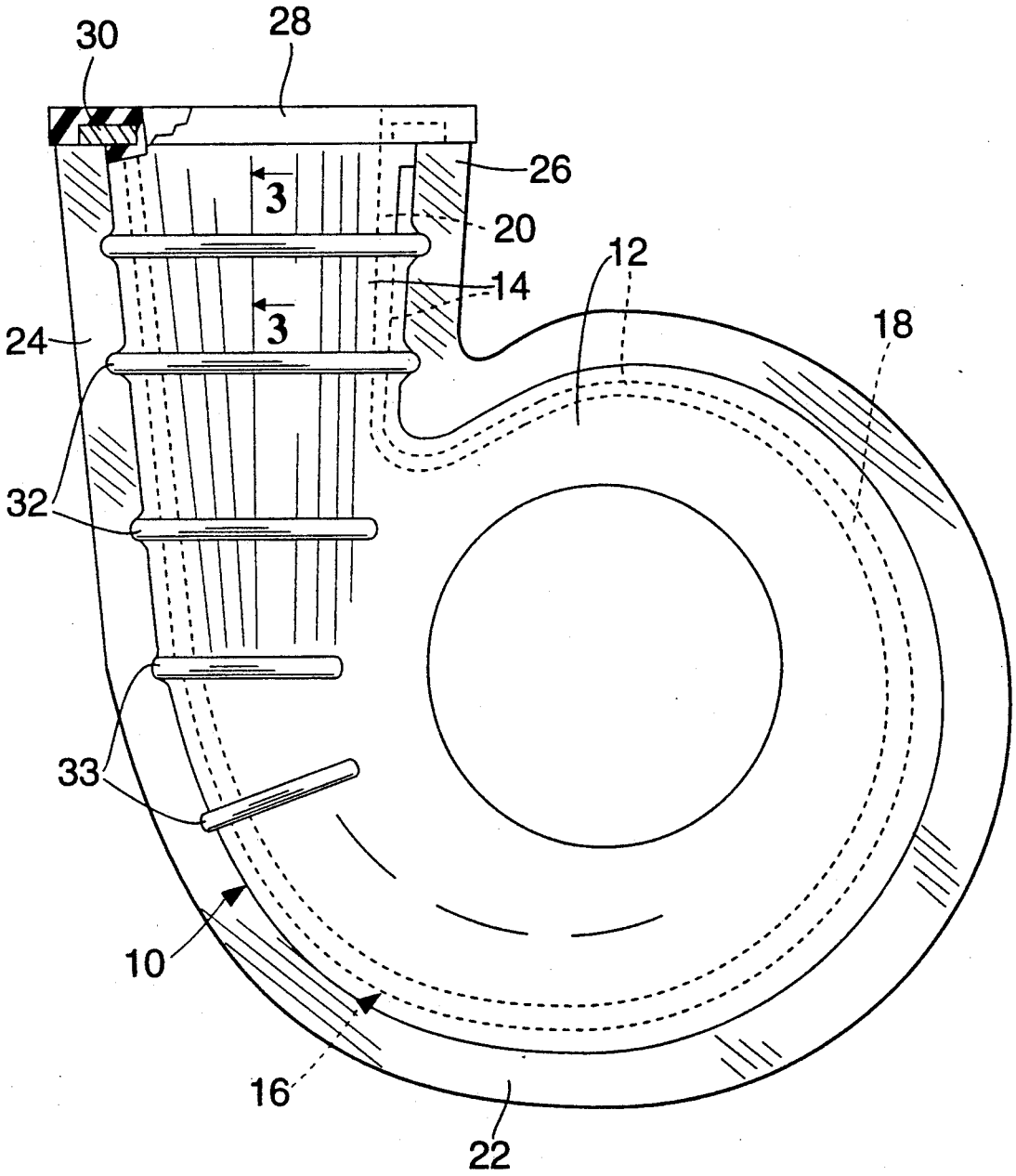
FIG. 2 is an elevational view of the lining of FIG. 1, showing the lining without the disk member.

As illustrated in FIG. 2, discharge section 14 of shell 10 is provided along an outer surface with a plurality of outwardly projecting semicircular reinforcement ribs 32 spaced longitudinally along the discharge section. Ribs 32 are integral with shell 10 and made of the same fiberglass reinforced resin material, as indicated generally in FIG. 3. Reinforcement ribs 32 fit into semicircular grooves (not shown) along the inner surface of a metal pump casing and serve to prevent curling of longitudinal edges of elastomer discharge section 20 during a curing step of a manufacturing process.

In addition, volute section 12 of shell 10 is provided along an outer surface with a plurality of outwardly projecting arcuate reinforcement ribs 33. Ribs 33 are likewise integral with shell 10 and made of the same fiberglass reinforced resin material. Reinforcement ribs 33 fit into semicircular grooves (not shown) along the inner surface of a metal pump casing.

It is to be noted that contrary to the teachings of the prior art, such as U.S. Pat. No. 4,776,760 to Grisz, the disclosure of which is hereby incorporated by reference, shell 10 contains both a complete volute section 12 and a discharge section 14. In addition, as discussed in greater detail hereinafter, the shell is preformed, i.e., cured, prior to attachment to elastomer layer 16 during a molding step. Because elastomer layer 16 is bonded or vulcanized essentially throughout its extent to preformed shell 10, there is no shrinkage of the elastomer layer during the curing process.

The material of shell 10 likewise does not shrink significantly during the curing of the shell. That material is a thermoset plastic resin material such as vinyl ester, polyester or epoxy resin, which has negligible shrinkage when reinforced with fiberglass. More particularly, as discussed in greater detail hereinafter, portions of shell 10 are formed of one or more layers of woven roving fiberglass fabric impregnated with the thermoset plastic resin and one or more layers of short nonwoven glass fibers dispersed randomly throughout a matrix of the thermoset plastic resin material. Some parts of shell 10 may consist only of glass fibers randomly embedded in the thermoset plastic resin material.

In manufacturing the centrifugal pump lining of FIGS. 1 and 2, strips or sheets of woven roving fiberglass fabric are placed on an inner surface of a mold. The fabric is then coated, e.g., via a brushing, rolling, squeegeeing or spraying operation, with the liquid, "A" stage plastic resin material so that the fabric is impregnated with the resin. Subsequently, a layer of glass fibers dispersed randomly in the resin is deposited over the impregnated fabric layer. A conventional fiberglass chopper gun is used to deposit the randomly dispersed glass fibers and resin.

A plurality of impregnated fab may be interleaved with a plurality of layers of randomly dispersed glass fibers. For example, some areas of shell 10 may have an outer fabric layer, then a first chopper applied layer, a second fabric layer, and another chopper applied layer.

Depending upon the size of the lining, shell 10 can be provided with any desired thickness in any area of the lining, to control strength and rigidity. A thickness of ¼ inch is considered average. Additional strength is obtained by forming ribs 32 along the outer surface of shell discharge section 14.

Upon completion of the fiberglass and resin layering, shell 10 is allowed to cure The cured shell 10 is then removed from its mold and placed into a mold of the same dimensions. Where the elastomer layer is rubber, the mold is a compression mold. Where the elastomer is urethane, molding is accomplished by a press.

Upon the disposition of shell 10 in the mold, an adhesive coating is applied to the inner surface of shell 10 and, by techniques described, for example, in U.S. Pat. No. 4,776,760 to Grisz, layer 16 is formed via compression molding of rubber material and simultaneously shell 10 is bonded throughout its extent to the elastomer layer via a vulcanization process.

Elastomer injection molding and transfer molding may also be used. In the event that the material of elastomer layer is cast urethane, heated liquid urethane is poured into a heated mold and cast without the application of pressure.

Ring segment 30 is embedded in elastomer layer 16 at the free end of discharge section 20 during elastomer molding.

Upon removal of shell 10 together with elastomer layer 16 from the compression mold, at least the discharge sections 14 and 20 of the lining are disposed over a support frame (not shown) for cooling. The support frame or plug helps to maintain the shape of the composite lining during the cooling thereof.

As discussed above, the vulcanizing of an elastomeric lining layer to a preformed shell produces a pump lining without shrinkage of the elastomer. The elimination of lining shrinkage facilitates the fitting of the lining to the casing independently of elastomer type. Errors inherent in predicting lining distortion upon cooling are eliminated.

It is to be noted that two half-shell linings as illustrated in the drawing are required to form an entire lining for a centrifugal pump casing.

A disk member 34 of the half-shell lining (FIG. 1) has an impeller shaft aperture or intake opening 36. Disk member 34 may be of conventional construction.

Although the invention has been described in terms of particular embodiments and applications, one of ordinary skill in the art, in light of this teaching, can generate additional embodiments and modifications without departing from the spirit of or exceeding the scope of the claimed invention. For example, principles of manufacture described herein with respect to a half-shell lining for a centrifugal pump casing can be applied to the manufacture of linings for other kinds of pumps, as well as to other devices requiring elastomer or rubber linings. If necessary, reinforcement ribs may be provided around the entire volute section, as well as along the discharge section, of a lining.

In addition, it is to be noted that shell 10 may be formed in the same mold used for compression molding elastomer layer 16. In that case, there is no need to transfer shell 10 from one mold to another.

Accordingly, it is to be understood that the drawings and descriptions herein are preferred by way of example to facilitate comprehension of the invention and should not be construed to limit the scope thereof.

What is claimed is:

1. A replaceable lining for a centrifugal pump casing, comprising:

a substantially continuous substantially rigid shell having a volute section and a discharge section integral therewith, said shell being made of a thermoset plastic resin material reinforced with glass fibers; and an elastomer layer adhesively bonded to said shell along an inner surface thereof.

2. The lining defined in claim 1 wherein said shell is provided along an outer surface with at least one outwardly projecting arcuate reinforcement rib.

3. The lining defined in claim 2 wherein said reinforcement rib is integral with said shell.

4. The lining defined in claim 2 wherein said shell is provided along an outer surface with a plurality of outwardly projecting arcuate reinforcement ribs spaced from one another along an outer surface of said discharge section of said shell.

5. The lining defined in claim 2 wherein said reinforcement rib is provided on said discharge section of said shell.

6. The lining defined in claim 2 wherein said reinforcement rib is provided on said volute section of said shell.

7. The lining defined in claim 1 wherein said shell includes a layer of fiberglass fabric material impregnated with said thermoset plastic resin material.

8. The lining defined in claim 7 wherein said shell further includes a layer of glass fibers dispersed randomly throughout a matrix of said thermoset plastic resin material.

9. The lining defined in claim 1 wherein said elastomer layer is provided at a free end of said discharge section with a semicircular metal reinforcement ring segment.

10. The lining defined in claim 1 wherein said elastomer layer is adhesively bonded to said shell along an inner surface thereof by a vulcanizing process.

11. A replaceable lining for a centrifugal pump casing, comprising:

an elastomer layer having a volute section and a discharge section integral therewith;

a reinforcement layer made of a fiberglass reinforced thermoset plastic resin material adhesively bonded to an outer surface of said discharge section; and at least one outwardly projecting reinforcement rib integral with said reinforcement layer.

12. The lining defined in claim 11 wherein said elastomer layer is adhesively bonded to said reinforcement layer along an inner surface thereof by a vulcanizing process.

13. The lining defined in claim 11 wherein said reinforcement rib is one of a plurality of outwardly projecting reinforcement ribs spaced from one another along said discharge section.

14. The lining defined in claim 11, further comprising a volute-shaped reinforcement layer integral with said reinforcement layer and made of the fiberglass reinforced thermoset plastic resin material, said volute-shaped reinforcement layer being adhesively bonded to an outer surface of said volute section of said elastomer layer.

15. The lining defined in claim 11 wherein said elastomer layer is provided at a free end of said discharge section with a semicircular metal reinforcement ring segment.

16. A method for manufacturing a replaceable lining for a pump casing, comprising the steps of:

forming a hard shell of a cured thermoset plastic resin material reinforced with fiberglass;

depositing an adhesive coating along an inner surface of said shell; and molding an elastomer layer onto said inner surface so that said elastomer layer is bonded thereto via said adhesive coating.

17. The method defined in claim 16 wherein said step of forming is implemented in a shell mold.

18. The method defined in claim 17 wherein said mold is also used to form said elastomer layer.

19. The method defined in claim 1 wherein a different mold is used to form said elastomer layer, further comprising the step of transfering said shell from said shell mold to said different mold.

20. The method defined in claim 17 wherein said step of forming comprises the steps of placing a woven roving fiberglass fabric into said shell mold, impregnating said roving fabric with said resin material, and depositing more of said resin material together with glass fibers in a random pattern over the impregnated roving fabric.

21. The method defined in claim 16, further comprising the step of providing at least one rib on an outer surface of said shell during said step of forming.

22. The method defined in claim 21 wherein said shell has a volute section and a discharge section integral therewith, said rib being provided on an outer surface of said discharge section during said step of forming.

23. The method defined in claim 16 wherein said step of molding is accomplished at normal molding temperatures.

24. The method defined in claim 16 wherein said step of molding vulcanizes said elastomer layer to said inner surface.

25. The method defined in claim 16 wherein said elastomer layer has a volute section and a substantially semicylindrical discharge section integral therewith, further comprising the step of attaching a semicircular metal reinforcement ring segment to a free end of the discharge section of said elastomer layer.

26. The method defined in claim 16, further comprising the steps of (a) removing from a mold said shell with said elastomer layer attached thereto, (b) disposing about a support frame at least a portion of said shell with said elastomer layer attached thereto, and (c) cooling said elastomer layer while maintaining said shell and said elastomer layer supported on said frame.

* * * * *

UNITED STATES PATENT AND TRADEMARK OFFICE

CERTIFICATE OF CORRECTION

PATENT NO. : 5,219,461

DATED : June 15, 1993

INVENTOR(S) : John Hyll, et al.

It is certified that error appears in the above-identified patent and that said Letters Patent is hereby corrected as shown below:

Column 1, line 37, change "typical" to --typically--; line 47, change "the" to --they--; line 60, insert --.-- (period) after "thereof".

Column 3, line 62, insert --lining-- after "half-shell".

Column 5, line 6, change "fab" to --fabric layers--.

Column 6, line 8, change "preferred" to --profferred--

Column 7, line 25, change "claim 1" to --claim 17--

Signed and Sealed this

Twenty-fourth Day of May, 1994

Bruce Lehman

*Attest:*

BRUCE LEHMAN

*Attesting Officer*

*Commissioner of Patents and Trademarks*